US008008848B2

(12) United States Patent
Park et al.

(10) Patent No.: US 8,008,848 B2
(45) Date of Patent: Aug. 30, 2011

(54) FIELD EMITTING DEVICE AND DISPLAY APPARATUS HAVING THE SAME

(75) Inventors: Haeil Park, Seoul (KR); Jae Byung Park, Seoul (KR); Donchan Cho, Seongnam-si (KR); Jinseob Byun, Seoul (KR); Sung-Jin Hong, Seoul (KR); Yu-Kwan Kim, Incheon (KR); Seon-Tae Yoon, Seoul (KR); Gunwoo Kim, Yongin-si (KR); Seul Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/837,862

(22) Filed: Jul. 16, 2010

(65) Prior Publication Data

US 2011/0050088 A1 Mar. 3, 2011

(30) Foreign Application Priority Data

Aug. 25, 2009 (KR) ..... 10-2009-0078903

(51) Int. Cl.
*H01J 1/62* (2006.01)

(52) U.S. Cl. ..... 313/495; 313/496

(58) Field of Classification Search ..... 313/495, 313/496, 309, 310, 336, 351
See application file for complete search history.

(56) References Cited

U.S. PATENT DOCUMENTS

| | | | | |
|---|---|---|---|---|
| 5,869,928 | A * | 2/1999 | Liu et al. | 313/495 |
| 7,339,324 | B2 * | 3/2008 | Lee et al. | 315/169.4 |
| 7,456,563 | B2 * | 11/2008 | Lee et al. | 313/495 |
| 2007/0114913 | A1 | 5/2007 | Lin et al. | |

FOREIGN PATENT DOCUMENTS

| | | |
|---|---|---|
| JP | 2007-184226 | 7/2007 |
| KR | 1020060047227 | 5/2006 |
| KR | 1020070001657 | 1/2007 |
| KR | 1020080035238 | 4/2008 |

* cited by examiner

*Primary Examiner* — Vip Patel
(74) *Attorney, Agent, or Firm* — F. Chau & Associates, LLC

(57) ABSTRACT

A field emitting device includes a base substrate and at least three light emitting units and configured to respectively emit at least three lights having different wavelengths from each other. Each light emitting unit includes a first electrode arranged on the base substrate, a field emitter arranged on the base substrate, an insulating layer arranged on the first electrode and including an opening to expose the field emitter, a second electrode arranged on the insulating later to control an operation of the field emitter, a third electrode facing the first electrode, and a fluorescent layer arranged on a surface of the third electrode facing the first electrode. A transmissive area is located between the florescent layers of two adjacent light emitting units.

20 Claims, 10 Drawing Sheets

FIELD EMITTING DEVICE AND DISPLAY APPARATUS HAVING THE SAME

CROSS-REFERENCE TO RELATED APPLICATION

This application claims priority to Korean Patent Application No. 2009-78903, filed on Aug. 25, 2009, the contents of which are incorporated by reference in its entirety herein.

BACKGROUND

1. Technical Field

Embodiments of the present invention relate to a field emitting device and a display apparatus having the same, and more particularly to a field emitting device and a display apparatus having the field emitting device.

2. Discussion of Related Art

A backlight unit of a display apparatus may employ a cold cathode fluorescent lamp (CCFL) as a line light source, or a light emitting diode (LED) as a point light source. However, such a backlight unit is expensive to manufacture due to its complicated structure. Further, since the line light source is located at a side of the backlight unit, the power consumption is relatively large due to the reflection and transmission of light. Moreover, it is more difficult to obtain a uniform brightness with a line light source as the size of the display apparatus increases.

A field emission type backlight unit having a flat light emitting structure uses less power than a backlight unit employing a CCFL, and has a relatively uniform brightness in a wide light-emitting area. A field emission type backlight unit may emit red, green, and blue lights. However, on occasion, the red, green, blue lights mix together, which may reduce quality of the display apparatus.

Thus, there is a need for a field emission type backlight unit that can emit red, green, and blue lights that prevents or reduces instances of color mixing, and a display apparatus including the field emission type backlight.

SUMMARY

A field emitting device according to an exemplary embodiment of the present invention includes a base substrate and light emitting units arranged on the base substrate and configured to respectively emit one of at least three lights having different wavelengths from each other. Each of the light emitting units includes a first electrode arranged on the base substrate, a field emitter arranged on the first electrode, an insulating layer arranged on the first electrode and including an opening to expose the field emitter, a second electrode arranged on the insulating layer to control an operation of the field emitter, a third electrode and spaced apart from the first electrode, and a fluorescent layer arranged on a surface of the third electrode facing the first electrode. A transmissive area is located between the florescent layers of two adjacent light emitting units.

A display apparatus according to an exemplary embodiment of the present invention includes a field emitting device including a base substrate and a plurality of light emitting units arranged on the base substrate and successively operated to respectively emit one of at least three lights having different wavelengths from each other, and a display panel including a pixel that controls a transmittance of the lights successively provided to display an image. Each of the light emitting units includes a first electrode arranged on the base substrate, a field emitter arranged on the first electrode to emit an electron beam, an insulating layer arranged on the first electrode and provided with an opening to expose the field emitter, a second electrode arranged on the insulating layer to control an operation of the field emitter, a third electrode and spaced apart from the first electrode to accelerate the electron beam emitted from the field emitter, and a fluorescent layer arranged on a surface of the third electrode facing the first electrode and colliding with the electron beam to output the light. A transmissive area through which the electron beam is transmitted is located between the florescent layers of two adjacent light emitting units.

A field emitting device according an exemplary embodiment of the present invention includes a base substrate, a cathode a cathode electrode arranged on the base substrate, first, second, and third distinct field emitters arranged on the first electrode, first and second insulating sections arranged on the first electrode, a first and second gate electrode located on the first insulating section, a third and fourth gate electrode located on the second insulating section, an anode electrode facing the cathode electrode and spaced apart from the first electrode, and distinct first, second, and third fluorescent layers. The first insulating section is located between the first and second field emitters and the second insulating section is located between second and third field emitters. The first and second gate electrodes are spaced apart from one another at opposite edges of the first insulating section. The third and fourth gate electrodes are spaced apart from one another at opposite edges of the second insulating section. The first fluorescent layer is arranged on a surface of the anode electrode facing the cathode electrode to overlap the first field emitter and extend up to the right most edge of the first gate electrode. The second fluorescent layer is arranged on a surface of the anode electrode facing the cathode electrode to overlap the second field emitter and extend from the left most edge of the second gate electrode to the rightmost edge of the third gate electrode. The third fluorescent layer is arranged on a surface of the anode electrode facing the cathode electrode to overlap the third field emitter and extend to the left most edge of the fourth gate electrode. Each of the fluorescent layers is configured to output light of a different wavelength.

The anode electrode may include a distinct first electrode, second electrode, and a third electrode, where the first electrode extends from a leftmost to a rightmost edge of the first fluorescent layer, the second electrode extends from a leftmost to a rightmost edge of the second fluorescent layer, and the third electrode extends from a leftmost to a rightmost edge of the third fluorescent layer.

BRIEF DESCRIPTION OF THE DRAWINGS

Embodiments of the present invention will become readily apparent by reference to the following detailed description when considered in conjunction with the accompanying drawings wherein.

DESCRIPTION OF EXEMPLARY EMBODIMENTS

Figure 1:
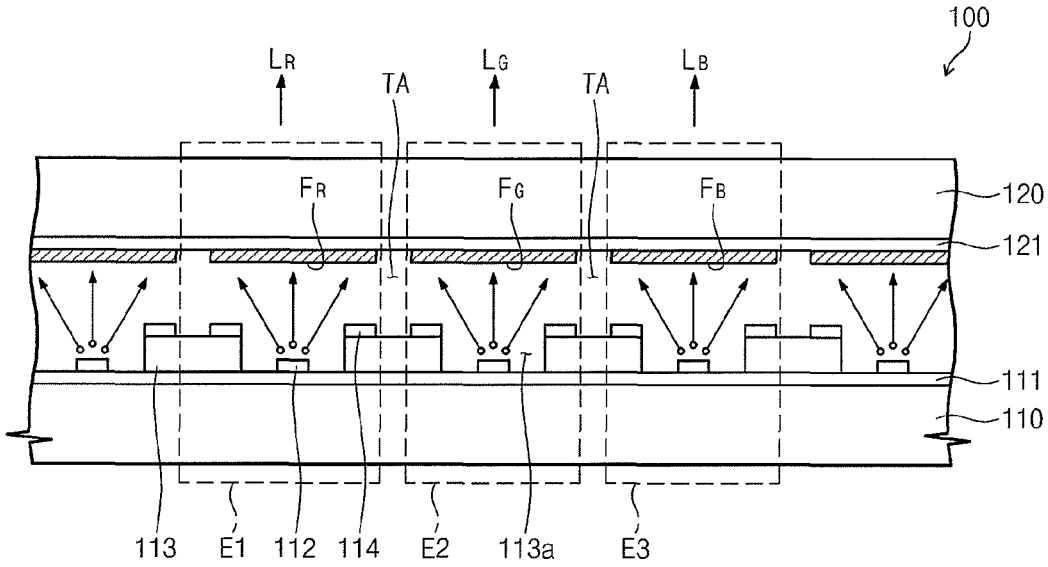
FIG. 1 is a cross-sectional view showing a field emitting device according to an exemplary embodiment of the present invention.

It will be understood that when an element or layer is referred to as being "on", "connected to" or "coupled to" another element or layer, it can be directly on, connected or coupled to the other element or layer or intervening elements or layers may be present. In the drawings, like reference numbers refer to like elements throughout. Hereinafter, exemplary embodiments of the present invention will be explained in detail with reference to the accompanying drawings.

Figure 2:
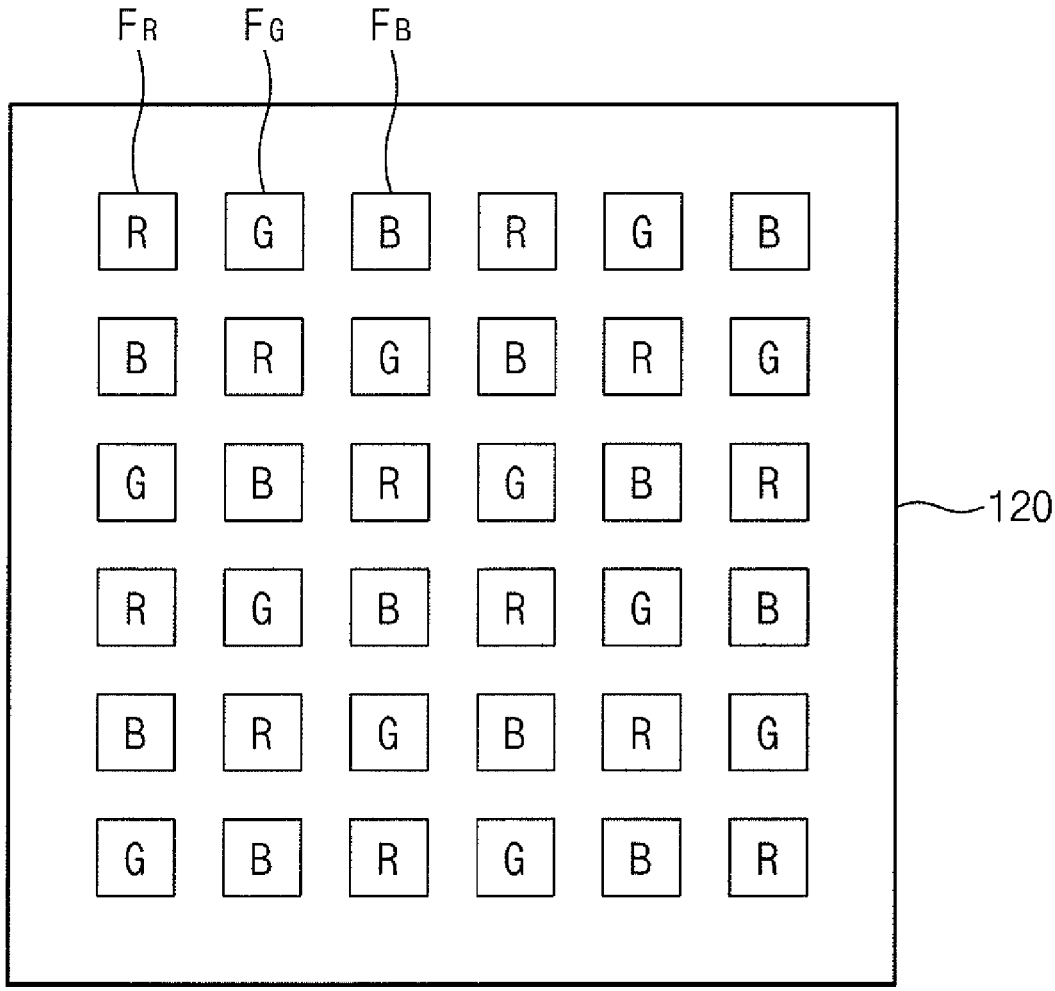
FIG. 2 is a plan view showing a fluorescent layer of FIG. 1.

FIG. 1 is a cross-sectional view showing a field emitting device according to an exemplary embodiment of the present invention, and FIG. 2 is a plan view showing a fluorescent layer of FIG. 1. Referring to FIGS. 1 and 2, a field emitting device 100 includes a base substrate 110, at least one first light emitting unit E1, at least one second light emitting unit E2, and at least one third light emitting unit E3. The base substrate 110 may include a transparent insulating material such as glass.

The first to third light emitting units E1, E2, and E3 are arrayed on the base substrate 110. The first light emitting unit E1 emits a first light $L_R$ having a red wavelength, the second light emitting unit E2 emits a second light $L_G$ having a green wavelength, and the third light emitting unit E3 emits a third light $L_B$ having a blue wavelength. The first to third light emitting units E1, E2, and E3 are successively operated within a predetermined time period. Thus, the field emitting device 100 may successively emit the first light $L_R$, the second light $L_G$, and the third light $L_B$.

Since the first, second, and third light emitting units E1, E2, and E3 have the same structure and function, for the convenience of explanation, only the first light emitting unit E1 will described in detail, and thus detailed descriptions of the second and third light emitting units E2 and E3 will be omitted.

The first light emitting unit E1 includes a cathode electrode 111, a field emitter 112, an insulating layer 113, a gate electrode 114, an anode electrode 121, and fluorescent layers $F_R$, $F_G$, and $F_B$.

The cathode electrode 111 is arranged on the base substrate 110. The cathode electrode 111 may be formed in a single layer or a multilayer structure and may include a conductive metal material.

The field emitter 112 and the insulating layer 113 are arranged on the cathode electrode 111. The insulating layer 113 may include a silicon oxide layer, a silicon nitride layer, or an organic layer, and the insulating layer 113 includes an opening 113*a* to expose the field emitter 112. The field emitter 112 may include carbon nanotubes to emit electrons. The carbon nanotubes may be grown on the cathode electrode 111 or a carbon nanotube emitter tip may be formed on the cathode electrode 111 using a polymer paste in which the carbon nanotubes are mixed.

The gate electrode 114 is arranged on the insulating layer 113 and may be positioned on the substantially upper side of the field emitter 112 (e.g., above the field emitter 112). When voltages are applied to the cathode electrode 111 and the gate electrode 114, respectively, the field emitter 112 emits electrons due to a voltage difference between the cathode and the gate electrodes 111 and 114. For example, a negative voltage may be applied to the cathode electrode 111, and a positive voltage may be applied to the gate electrode 114.

Further, a voltage having a certain frequency may be applied to the gate electrode 114. The frequency of the voltage applied to the gate electrode 114 may be the same as, about the same as, an exact multiple of, or about a multiple of an operation frequency of a display panel. For example, if the operation frequency of the display panel is about 60 Hz or 120 Hz, the voltage applied to the gate electrode 114 may be about 60 Hz, 120 Hz, or the exact multiple of the operation frequency.

The anode electrode 121 faces the cathode electrode 111 and is spaced apart from the cathode electrode 111 with a predetermined distance. The anode electrode 121 may include a transparent conductive material, such as indium tin oxide (ITO) or indium zinc oxide (IZO), and accelerate the electrons emitted from the field emitter 112. When the negative voltage is applied to the cathode electrode 111 and the positive voltage is applied to the anode electrode 121, the electrons emitted from the field emitter 112 due to the voltage difference between the cathode and anode electrodes 111 and 121 are accelerated to the anode electrode 121 to generate an electron beam.

The anode electrode 121 may be formed entirely over a lower surface of an opposite substrate 120 that faces an upper surface of the base substrate 110. Although not shown in FIGS. 1 and 2, a spacer may be arranged between the base substrate 110 and the opposite substrate 120 to provide a space through which the electrons are accelerated.

Although not shown in FIG. 1, a separate controller may be provided to generate the above described positive voltage, negative voltage, and the voltage of a particular frequency.

In FIG. 1, the anode electrode 121 is arranged on the opposite substrate 120. However, as another exemplary embodiment, the field emitting device 100 (e.g., a field emitter) may include an electrode substrate in which the anode electrode 121 and the opposite substrate 120 are integrally formed with each other (e.g., formed together within a single layer). When the anode electrode 121 and the opposite substrate 120 are integrally formed, the electrode substrate may include ITO or IZO.

The fluorescent layers $F_R$, $F_G$, and $F_B$ are formed on a surface of the anode electrode 121 facing the cathode electrode 111. The fluorescent layers $F_R$, $F_G$, and $F_B$ of the first light emitting unit E1 include a red fluorescent layer $F_R$ that collides with the electron beam accelerated to the anode electrode 121 to emit the first light $L_R$ having the red wavelength. The second light emitting unit E2 includes a green fluorescent layer $F_G$ emitting the second light $L_G$ having the green wavelength, and the third light emitting unit E3 includes a blue fluorescent layer $F_B$ emitting the third light $L_B$ having the blue wavelength.

A transmissive area TA through which the electron beam is transmitted is defined between the two adjacent florescent layers. As shown in FIG. 2, the red, green, and blue fluorescent layers $F_R$, $F_G$, and $F_B$ are arranged on the opposite substrate 120 in a matrix configuration. The transmissive area TA is formed to surround the red, green and blue fluorescent layers $F_R$, $F_G$, and $F_B$. Therefore, each of the red, green, and blue fluorescent layers $F_R$, $F_G$, and $F_B$ is spaced apart from adjacent fluorescent layers by the transmissive area TA, thereby having an island shape.

As described above, when the transmissive area TA is provided in a border area between the red, green, and blue fluorescent layers $F_R$, $F_G$, and $F_B$, even though the electron beam emitted from one of the light emitting units travels toward an adjacent light emitting unit, colors of lights may be prevented from being mixed with each other in the border area between the two adjacent light emitting units.

The field emitting device 100 successively emits the first light $L_R$ during a first period, emits the second light $L_G$ during a second period, and emits the third light $L_B$ during a third period.

In other words, the field emitting device 100 that successively emits the lights having different wavelengths from each other includes the transmissive area TA in border areas between the red, green, and blue fluorescent layers $F_R$, $F_G$, and $F_B$, to thereby prevent the colors of the lights from being mixed with each other.

Figure 3:
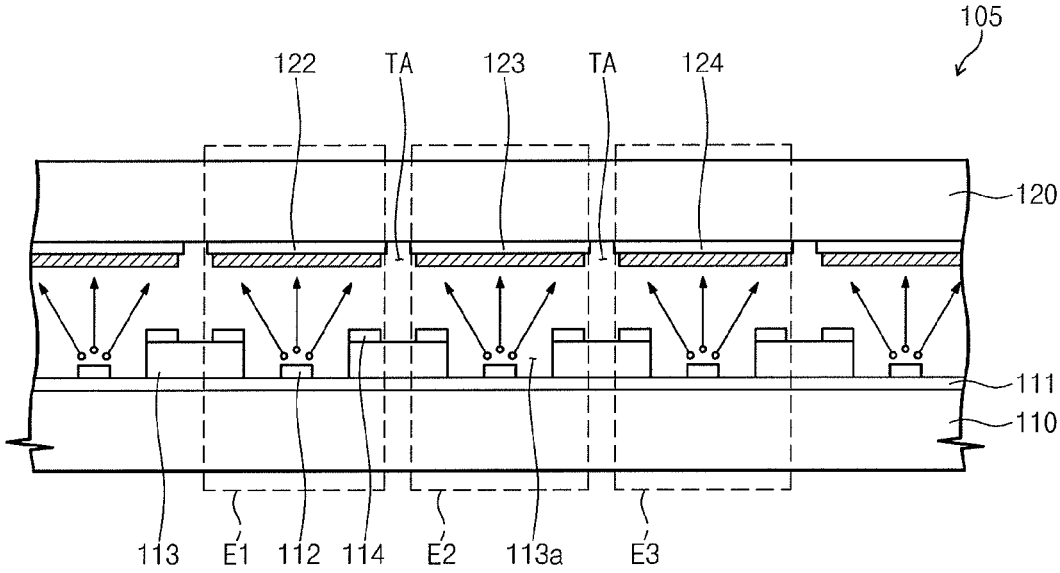
FIG. 3 is a cross-sectional view showing a field emitting device according to an exemplary embodiment of the present invention.
Figure 4:
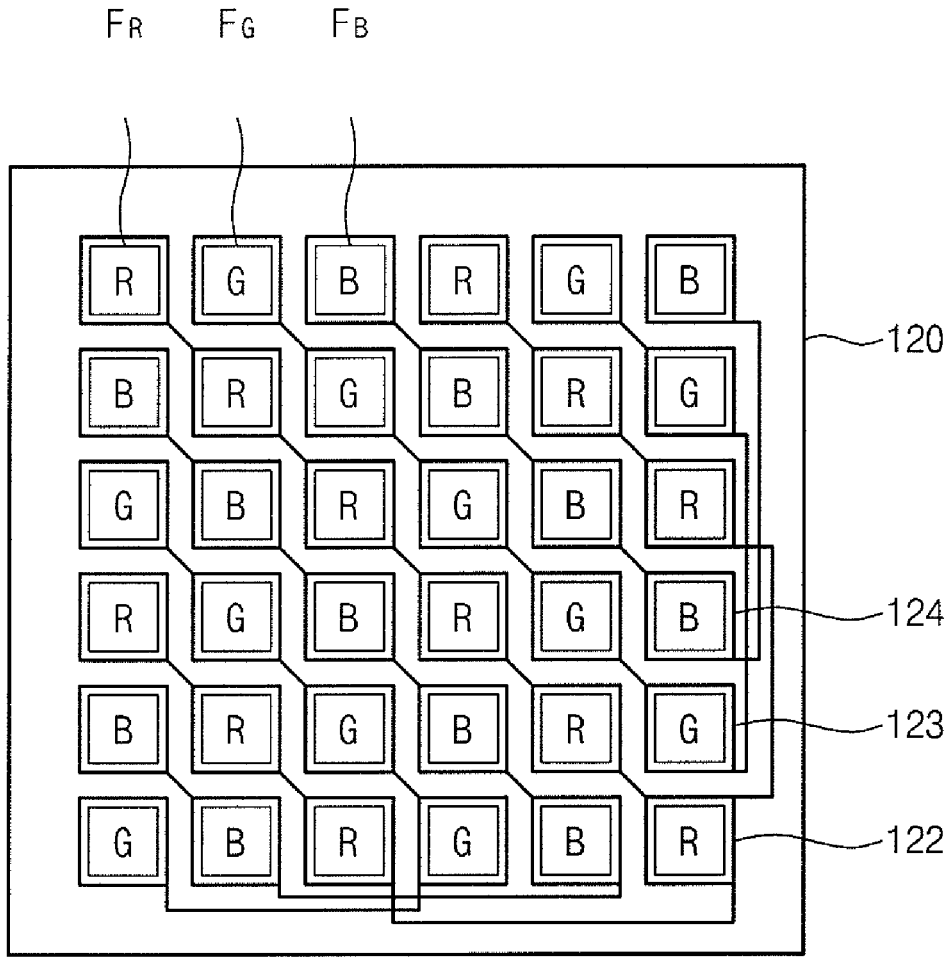
FIG. 4 is a plan view showing a fluorescent layer and an anode electrode of FIG. 3.

FIG. 3 is a cross-sectional view showing a field emitting device according to an exemplary embodiment of the present invention, and FIG. 4 is a plan view showing a fluorescent layer and an anode electrode of FIG. 3. In FIGS. 3 and 4, the same reference numerals denote the same elements in FIGS. 1 and 2, and thus the detailed descriptions of the same elements will be omitted.

Referring to FIGS. 3 and 4, anode electrodes 122, 123, and 124 patterned in the same shape as fluorescent layers $F_R$, $F_G$, and $F_B$ are arranged on an opposite substrate 120. Therefore, a transmissive area TA is defined between two anode electrodes adjacent each other. For example, anode electrodes of two light emitting units adjacent each other may be spaced apart from each other by the transmissive area TA.

As shown in FIG. 4, among the anode electrodes 122, 123, and 124, first anode electrodes 122 respectively corresponding to the red fluorescent layers $F_R$ are electrically connected to each other. Second anode electrodes 123 corresponding to green fluorescent layers $F_G$ among the anode electrodes 122, 123, and 124, respectively, are electrically connected to each other. Also, third anode electrodes 124 corresponding to blue fluorescent layers $F_B$ in one-to-one correspondence among the anode electrodes 122, 123, and 124 are electrically connected to each other.

The first anode electrodes 122 are electrically separated from the second anode electrodes 123 and the third anode electrodes 124, and the second anode electrodes 123 are electrically separated from the third anode electrodes 124. For example, the anode electrodes of the light emitting units that emit lights having different wavelengths from each other are electrically separated from each other. Consequently, the electron beam emitted from one of the light emitting units may be prevented from being accelerated to the anode electrode of an adjacent light emitting unit, thereby preventing colors of lights from being mixed with each other.

Figure 5:
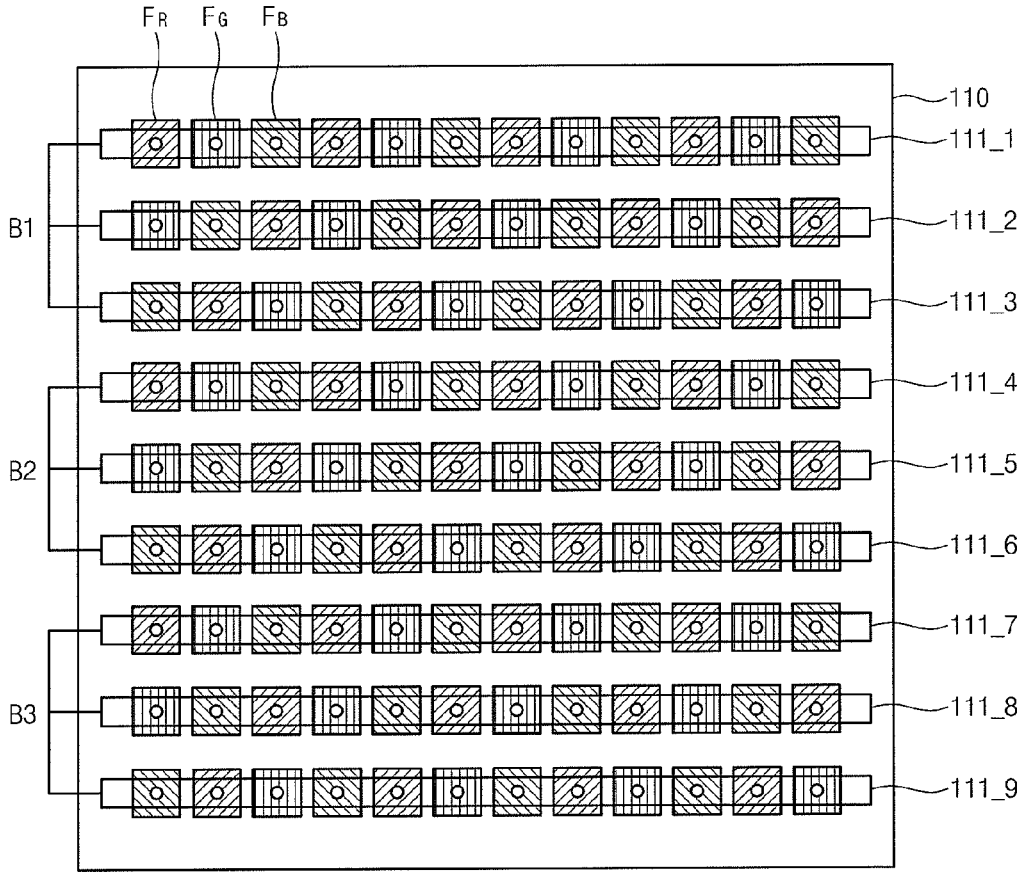
FIG. 5 is a plan view showing the field emitting device of FIG. 1.

FIG. 5 is a plan view showing the field emitting device of FIG. 1. Referring to FIG. 5, the base substrate 110 is divided into a plurality of areas, and a plurality of light generating blocks are arranged in the areas in one-to-one correspondence. In FIG. 5, three light generating blocks B1, B2 and B3 (hereinafter, referred to as a first light generating block B1, a second light generating block B2, and a third light generating block B3) are shown. Each of the first to third light generating blocks B1, B2, and B3 includes a plurality of red light emitting units E1, a plurality of green light emitting units E2, and a plurality of blue light emitting units E3.

Among the first, second, third periods that are successive, the first to third light generating blocks B1, B2, and B3 are successively operated to emit the first light $L_R$ during the first period. For example, the red light emitting units E1 included in the first light generating block B1 generate the first light $L_R$, and then the red light emitting units E1 included in the second light generating block B2 generate the first light $L_R$, and then the red light emitting units E1 included in the third light generating block B3 generate the first light $L_R$.

The red light emitting units E1 of the first to third light generating blocks B1, B2, and B3 are turned on during the first period, but the green light emitting units E2 and the blue light emitting units E3 are turned off during the first period. Thus, only the first light $L_R$ is generated from the red light emitting units E1 during the first period.

Further, the first to third light generating blocks B1, B2, and B3 are successively operated to generate the second light $L_G$ during the second period. The green light emitting units E2 of the first to third light generating blocks B1, B2, and B3 are turned on during the second period, but the blue light emitting units E3 and the red light emitting units E1 are turned off during the second period. Thus, only the second light $L_G$ is generated from the green light emitting units E2 during the second period.

The first to third light generating blocks B1, B2, and B3 are successively operated to generate the third light $L_B$ during the third period. The blue light emitting units E3 of the first to third light generating blocks B1, B2, and B3 are turned on during the third period, but the red light emitting units E1 and the green light emitting units E2 are turned off during the third period. Thus, only the third light $L_B$ is generated from the blue light emitting units E3 during the third period.

As shown in FIG. 5, the light emitting units E1, E2, and E3 included in each of the first to third light generating blocks B1, B2, and B3 are arranged in a matrix configuration. The cathode electrodes 111 of the light emitting units E1, E2, and E3 arranged in a row direction are electrically connected to each other to form one line electrode.

FIG. 5 shows an exemplary embodiment where one light generating block includes three line electrodes. First, second and third line electrodes 111_1, 111_2, and 111_3 of the first light generating block B1 may be electrically connected to each other, and fourth, fifth and sixth line electrodes 111_4, 111_5, and 111_6 of the second light generating block B2 may be electrically connected to each other. Also, seventh, eighth and ninth line electrodes 111_7, 111_8, and 111_9 of the third light generating block B3 may be electrically connected to each other.

Although not shown in figures, the gate electrodes 114 of the light emitting units E1, E2, and E3 arranged in a column direction may be electrically connected to each other to form one line electrode.

As another exemplary embodiment of the present invention, each of the line electrodes included in each light generating block may be integrally formed with adjacent line electrodes to form a surface electrode. A structure in which cathode electrodes are connected to each other to form the surface electrode is illustrated in FIG. 6.

Figure 6:
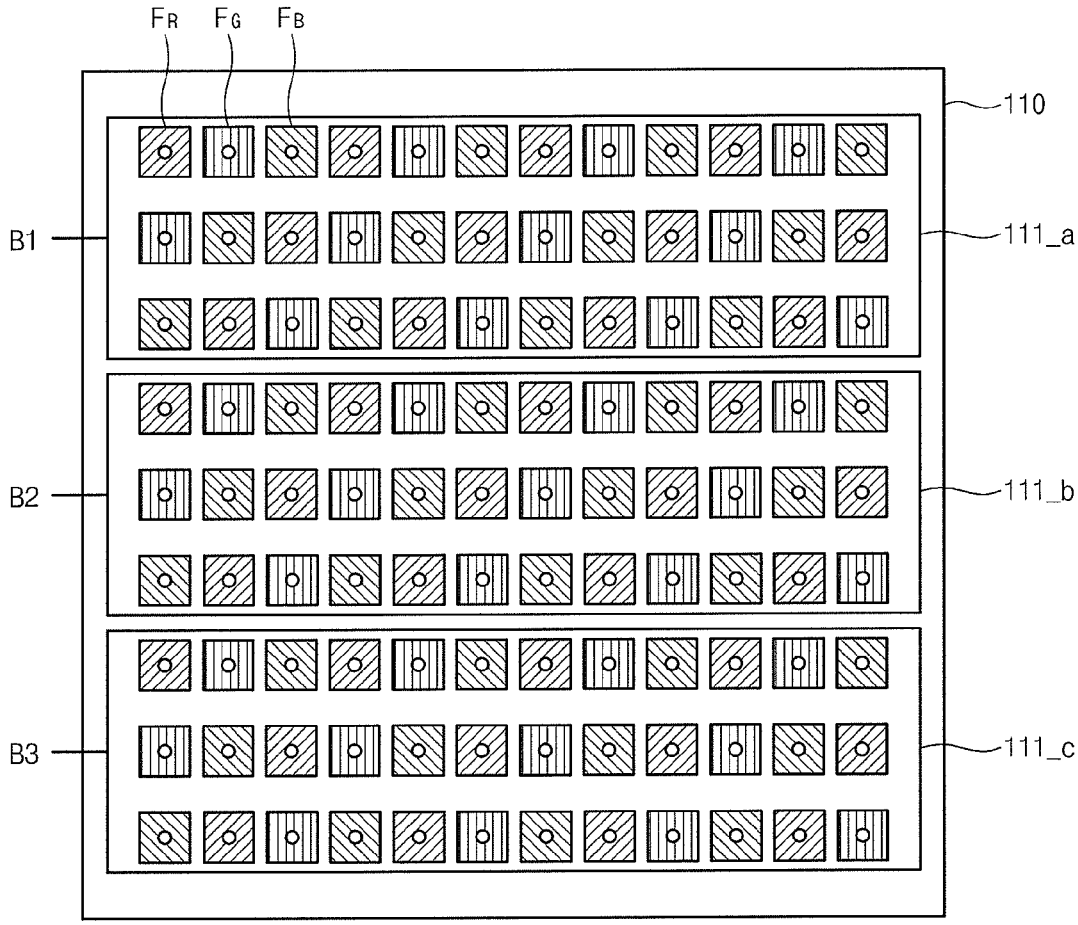
FIG. 6 is a plan view showing a field emitting device according to an exemplary embodiment of the present invention.

FIG. 6 is a plan view showing a field emitting device according to an exemplary embodiment of the present invention. In FIG. 6, the same reference numerals denote the same elements in FIG. 5, and thus the detailed descriptions of the same elements will be omitted.

Referring to FIG. 6, the first light generating block B1 includes a first surface electrode 111_*a* in which the cathode electrodes 111 of the light emitting units E1, E2, and E3 arranged in three rows are electrically connected to each other. Similarly, the second light generating block B2 includes a second surface electrode 111_*b* in which the cathode electrodes 111 of the light emitting units E1, E2, and E3 arranged in three rows are electrically connected to each other. Also, the third light generating block B3 includes a third surface electrode 111_*c* in which the cathode electrodes 111 of the light emitting units E1, E2, and E3 arranged in three rows are electrically connected to each other.

Figure 7:
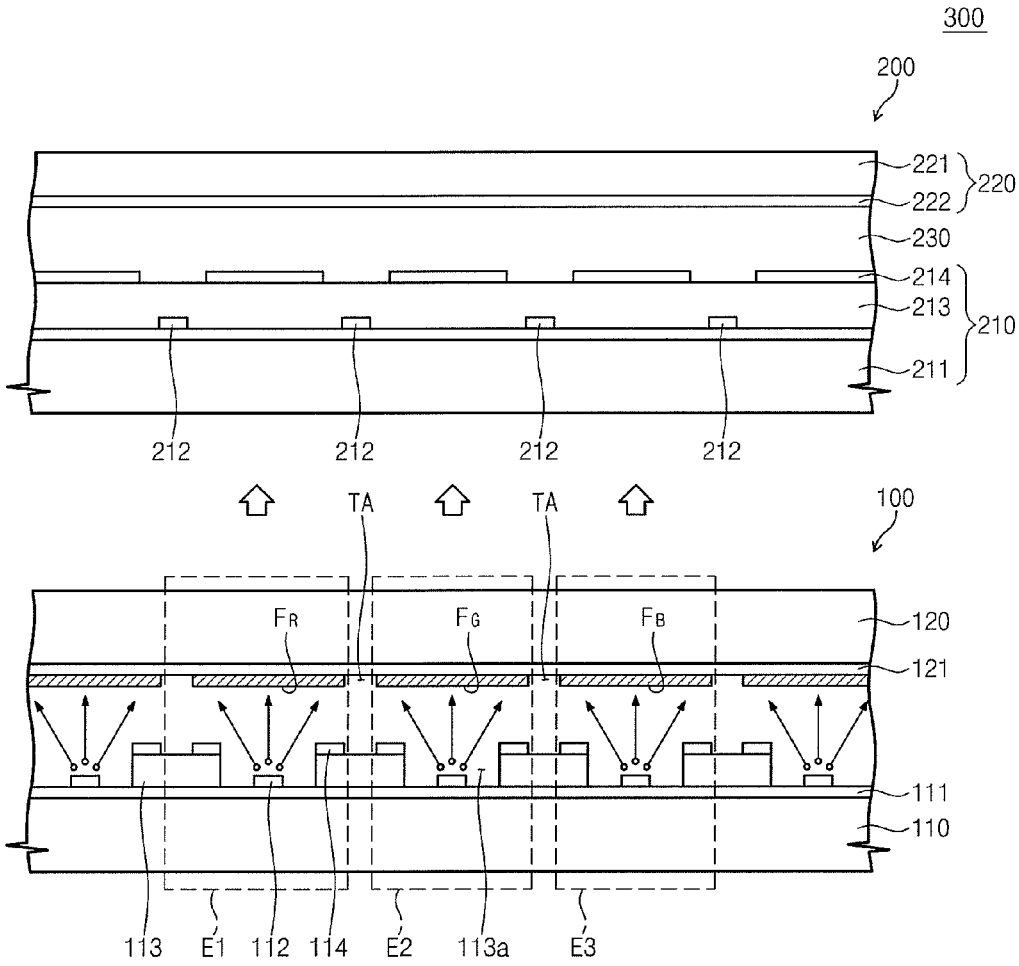
FIG. 7 is a cross-sectional view showing a display apparatus employing the field emitting device of FIG. 1 according to an exemplary embodiment of the present invention.

FIG. 7 is a cross-sectional view showing a display apparatus employing the field emitting device of FIG. 1 according to an exemplary embodiment of the present invention. In an alternate embodiment, the display apparatus of FIG. 7 instead employs the field emitting device of FIG. 3. In FIG. 7, the same reference numerals denote the same elements in FIG. 1, and thus the detailed descriptions of the same elements will be omitted.

Referring to FIG. 7, a display apparatus 300 includes a field emitting device 100 successively emitting a first light $L_R$, a second light $L_G$, and a third light $L_B$ and a display panel 200 successively receiving the first to third lights $L_R$, $L_G$, and $L_B$ to display a desired color image.

Since the field emitting device 100 has the same structure and function as the field emitting device 100 of FIG. 1, the detailed descriptions of the field emitting device 100 will be omitted.

The display panel 200 includes a lower substrate 210, an upper substrate 220 facing the lower substrate 210, and a liquid crystal layer 230 disposed (e.g., located) between the lower substrate 210 and the upper substrate 220.

The lower substrate 210 includes a first substrate 211, and a plurality of pixels arranged on the first substrate 211 in a matrix configuration. Each of the pixels includes a thin film transistor 212 and a pixel electrode 214 connected to a drain electrode of the thin film transistor 212. An insulating layer 213 may be further arranged between the thin film transistor 212 and the pixel electrode 214.

Although not shown in FIG. 7, a plurality of gate lines and a plurality of data lines are arranged on the lower substrate 210. The gate lines extend in a row direction, and the data lines extend in a column direction. Thus, the pixels are successively turned on in a row in response to gate signals sequentially applied through the gate lines. Data signals applied to the data lines are charged to turn on pixels. Each pixel controls a transmittance of a light provided from the field emitting device 100 by the data signal charged thereto. The upper substrate 220 includes a second substrate 221 and a common electrode 222 facing the pixel electrodes 214.

Since the field emitting device 100 successively emits the first to third lights $L_R$, $L_G$, and $L_B$ having red, green, and blue wavelengths, respectively, the display panel 200 does not require a color filter having red, green, and blue colors. Thus, a color filter layer is not arranged on the lower substrate 210 and the upper substrate.

When a time period that is required to display one image through the display panel 200 is defined as one frame, the one frame is divided into a first period, a second period, and a third period, which are successive. For example, when the one frame is about 16.7 ms, each of the first to third periods may be set to about 5.56 ms. Therefore, a field emitting device 100 according to this embodiment may be operated at about 180 Hz. A red data signal used to control the transmittance of the first light $L_R$ is provided to the display panel 200 during the first period, a green data signal used to control the transmittance of the second light $L_G$ is provided to the display panel 200 during the second period, and a blue data signal used to control the transmittance of the third light $L_B$ is provided to the display panel 200 during the third period. Although not shown in the figures, a controller may be provided to generate the red, green, and blue signals.

Accordingly, the display panel 200 controls the transmittance of the first to third lights $L_R$, $L_G$, and $L_B$ that are successively provided, and thus an image corresponding to the one frame and having a desired color and gray scale may be displayed through the display panel 200.

Figure 8:
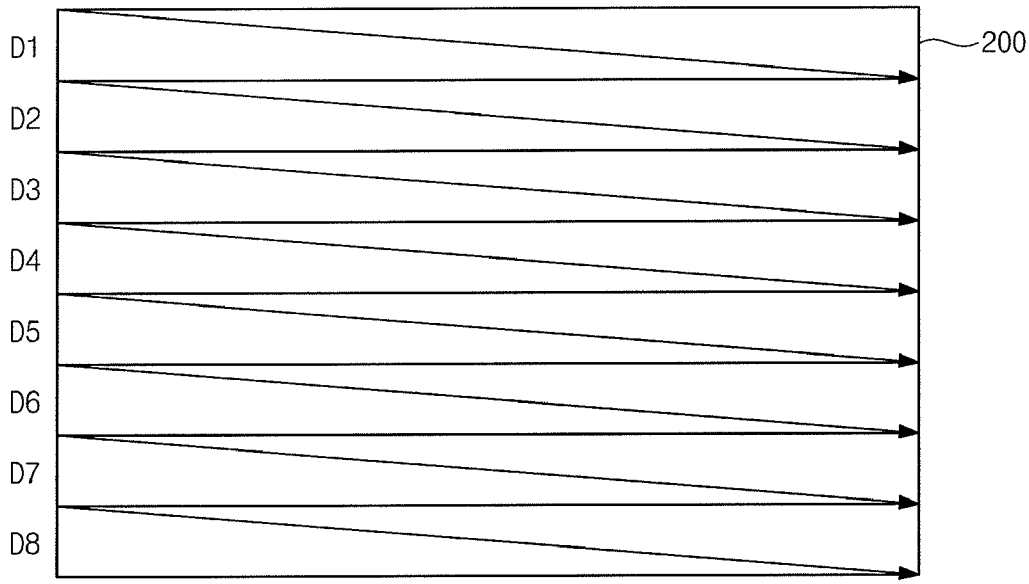
FIG. 8 is a plan view showing a display panel of FIG. 7.
Figure 9:
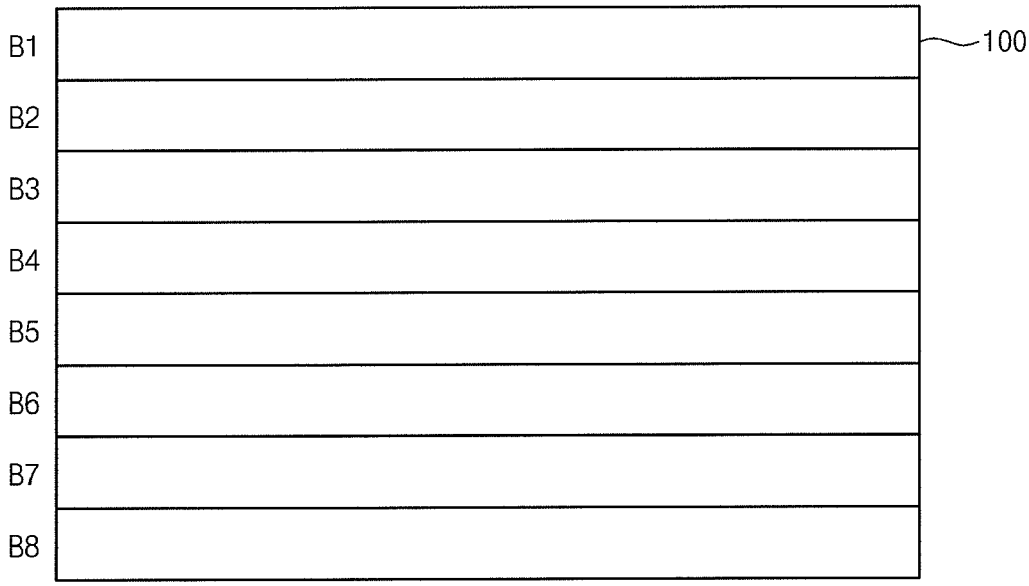
FIG. 9 is a plan view showing a field emitting device of FIG. 7.

FIG. 8 is a plan view showing the display panel of FIG. 7, and FIG. 9 is a plan view showing the field emitting device of FIG. 7. Referring to FIGS. 8 and 9, the display panel 200 is divided into a plurality of display areas D1~D8, and the field emitting device 100 is divided into a plurality of light generating blocks B1~B8 corresponding to the display areas D1~D8 in one-to-one correspondence.

For a single frame divided into the first to third periods, when the light emitting units of the field emitting device 100 corresponding to each period are turned on after the pixels included in the display panel 200 are charged, it may be difficult to ensure sufficient turn-on time for the corresponding light emitting units. For example, when the red light emitting units are turned on during a portion of the first period obtained by subtracting the charge time that is required to charge the pixels of the display panel 200 from the first period, it may be difficult to ensure sufficient turn-on time for the red light emitting units.

Therefore, when the display panel 200 is divided into the eight display areas D1~D8 and the light emitting units of the corresponding light generating block are turned on after the pixels of each display area D1~D8 are charged, the turn-on time for the corresponding light emitting units may be ensured. For example, when the pixels of the first display area D1 are charged, the red light emitting units of the first light generating block B1 corresponding to the first display area D1 are turned on, and when the pixels of the second display area D2 are charged, the red light emitting units of the second light generating block B2 corresponding to the second display area D2 are turned on. As described above, the light emitting units are turned on in a block, thereby ensuring a flashing time of each light emitting unit.

Figure 10:
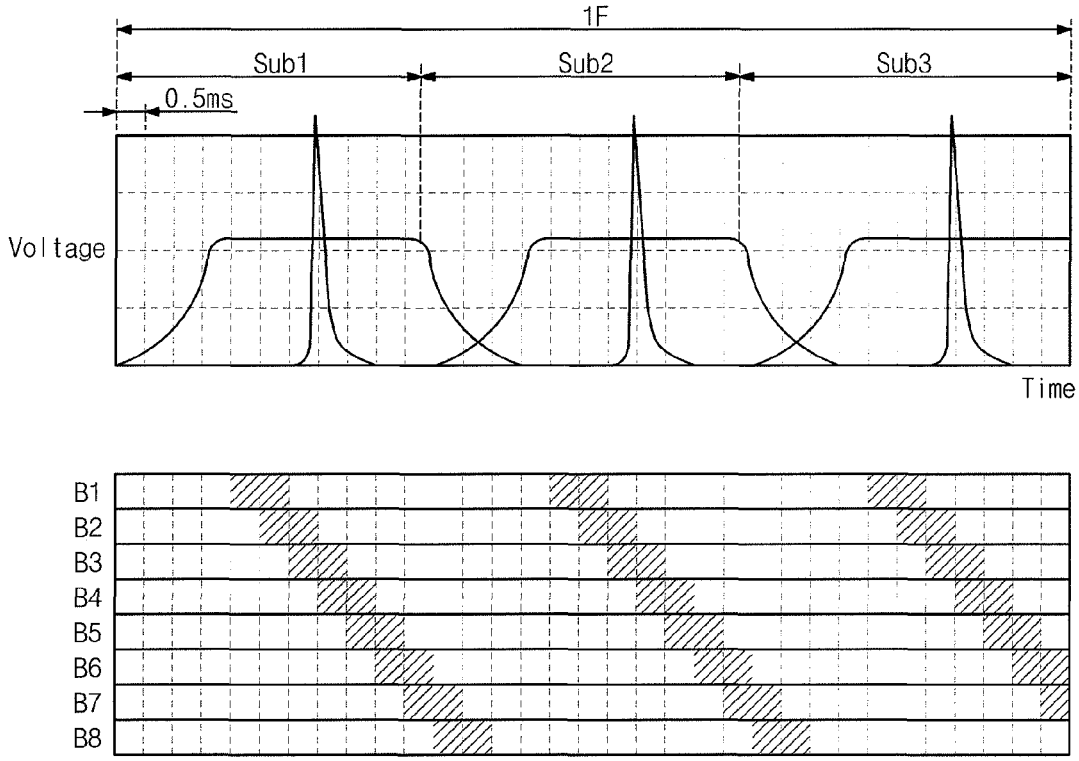
FIG. 10 is a timing diagram illustrating exemplary operations of the display panel of FIG. 8 and the field emitting device of FIG. 9 according to an exemplary embodiment of the present invention.

FIG. 10 is a timing diagram illustrating exemplary operations of the display panel of FIG. 8 and the field emitting device of FIG. 9 according to an exemplary embodiment of the present invention.

Referring to FIG. 10, the one frame 1F is divided into the first period sub1, the second period sub2, and the third period sub3, which are successive. During the first period sub1 within the one frame 1F, the red data signal is charged to the display panel 200. When the red data signal is charged to the first display area D1, the red light emitting units in the first light generating block B1 are turned on to emit the first light $L_R$. After a certain time period lapses, the red light emitting units in the second light generating block B2 are turned on to emit the first light $L_R$. Also, the red light emitting units in the light generating blocks B3~B8 are successively turned on with a uniform time interval to emit the first light $L_R$. In at least one exemplary embodiment, the turn-on time of the red light emitting units in each light generating block may be set to about 1 ms.

During the second period sub2 within the one frame 1F, the green data signal is charged to the display panel 200. When the green data signal is charged to the first display area D1, the green light emitting units in the first light generating block B1 are turned on to emit the second light $L_G$. After a certain time period, the green light emitting units in the second light generating block B2 are turned on to emit the second light $L_G$.

Similarly, the green light emitting units in the light generating blocks B3~B8 are successively turned on with a uniform time interval to emit the second light $L_G$. In at least one exemplary embodiment, the turn-on time of the green light emitting units in each light generating block may be set to about 0.7 ms.

Similar to the above, during the third period sub3 within the one frame F1, the blue data signal is charged to the display panel 200. When the blue data signal is charged to the first display area D1, the blue light emitting units in the first light generating block B1 are turned on to emit the third light LB. After a certain time period, the blue light emitting units in the second light generating block B2 are turned on to emit the third light $L_B$. The blue light emitting units in the light generating blocks B3~B8 are successively turned on with a uniform time interval to emit the third light $L_B$. In at least one exemplary embodiment, the turn-on time of the blue light emitting units in each light generating block may be set to about 0.1 ms.

Since the field emitting device 100 may generate light having a desired brightness within a short time period, the flashing time of the light emitting unit may be relatively shortened compared to other types of light source devices. Thus, the light emitting units may be successively turned on in a block, thereby preventing the colors of the lights from being mixed with each other between the last light generating block and the first light generating block.

Figure 11:
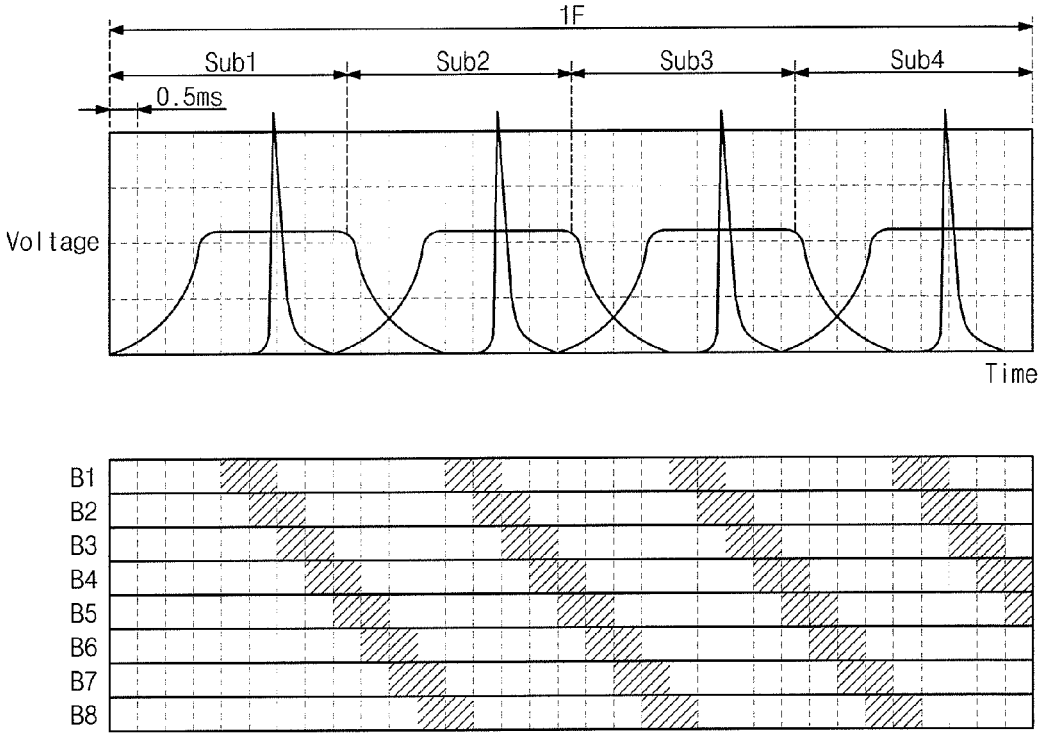
FIG. 11 is a timing diagram illustrating exemplary operations of a display panel and a field emitting device according to an exemplary embodiment of the present invention.

FIG. 11 is a timing diagram illustrating exemplary operations of a display panel and a field emitting device according to an exemplary embodiment of the present invention. FIG. 11 shows a charge of a data signal applied to a display panel 200 when a field emitting device further emits a white light in addition to first, second and third lights $L_R$, $L_G$, and $L_B$.

Referring to FIG. 11, one frame 1F is divided into a first period sub1, a second period sub2, a third period sub3, and a fourth period sub4, which are successive. For example, when one frame IF is about 16.67 ms, since the one frame 1F is divided into four periods, each period is set to about 4.17 ms. Therefore, a field emitting device 100 according to this embodiment may be operated at 240 Hz.

Although the operation frequency of the field emitting device 100 increases from 180 Hz to about 240 Hz, a flashing time of the first light generating block may overlap with a flashing time of the last light generating block by about 0.5 ms.

For example, since the flashing time of the light emitting units of the field emitting device 100 is relatively short compared to other types of light source devices, even though the operation frequency increases, the flashing time during which the light generating blocks that generate different lights are substantially simultaneously flashed may be minimized. As a result, deterioration of a display quality, which is caused by mixing the colors of the lights, may be prevented.

Although exemplary embodiments of the present invention have been described, it is understood that the present invention is not limited to these exemplary embodiments, and various changes can be made by one ordinary skilled in the art within the spirit and scope of the disclosure.

What is claimed is:

1. A field emitting device comprising:

a base substrate; and light emitting units arranged on the base substrate and configured to respectively emit one of at least three lights having different wavelengths from each other, wherein each of the light emitting units comprises:

a first electrode arranged on the base substrate;

a field emitter arranged on the first electrode;

an insulating layer arranged on the first electrode and including an opening to expose the field emitter;

a second electrode arranged on the insulating layer to control an operation of the field emitter;

a third electrode facing the first electrode and spaced apart from the first electrode to accelerate the electron beam emitted from the field emitter; and a fluorescent layer arranged on a surface of the third electrode, wherein a transmissive area is located between the florescent layers and the third electrodes of two adjacent light emitting units, and wherein an edge of each of the third electrodes of the two adjacent light emitting unit contacts the transmissive area.

2. The field emitting device of claim 1, wherein the light emitting units comprise:

a red light emitting unit to emit a first light having a red wavelength;

a green light emitting unit to emit a second light having a green wavelength; and a blue light emitting unit to emit a third light having a blue wavelength.

3. The field emitting device of claim 2, wherein the red, green, and blue light emitting units are successively operated within a predetermined time period.

4. The field emitting device of claim 2, wherein the base substrate is divided into a plurality of areas, a plurality of light generating blocks is arranged in the areas in one-to-one correspondence, and each light generating block comprises the red, green, and blue light emitting units.

5. The field emitting device of claim 4, wherein the light generating blocks are successively operated to generate the first light during a first period, the second light during a second period, and the third light during a third period.

6. The field emitting device of claim 5, wherein the red light emitting unit is turned on and the green and blue light emitting units are turned off during the first period, the green light emitting unit is turned on and the blue and red light emitting units are turned off during the second period, and the blue light emitting unit is turned on and the red and green light emitting units are turned off during the third period.

7. The field emitting device of claim 4, wherein the light emitting units included in each of the light generating blocks are arranged in a matrix configuration, and the first electrodes of the light emitting units arranged in a row direction are electrically connected with each other to form a plurality of line electrodes.

8. The field emitting device of claim 7, wherein each of the line electrodes is integrally formed with at least two line electrodes adjacent thereto to form a surface electrode.

9. The field emitting device of claim 2, wherein the third electrode of each of the light emitting units is arranged corresponding to an area where the fluorescent layer is formed, and the third electrode of each of the light emitting units is electrically connected to the third electrode of the light emitting units that output a light having a same wavelength.

10. A display apparatus comprising:

a field emitting device including a base substrate and a plurality of light emitting units arranged on the base substrate and successively operated to respectively emit one of at least three lights having different wavelengths from each other; and a display panel including a pixel that controls a transmittance of the lights successively provided to display an image, wherein each of the light emitting units comprises:

a first electrode arranged on the base substrate;

a field emitter arranged on the first electrode to emit an electron beam;

an insulating layer arranged on the first electrode and including an opening to expose the field emitter;

a second electrode arranged on the insulating layer to control an operation of the field emitter;

a third electrode facing the first electrode and spaced apart from the first electrode to accelerate the electron beam emitted from the field emitter; and a fluorescent layer arranged on a surface of the third electrode facing the first electrode and colliding with the electron beam to output the light, wherein a transmissive area through which the electron beam is transmitted is located between the florescent layers and the third electrodes of two adjacent light emitting units to form a plurality of florescent layer parts and plurality of third electrode parts, and wherein at least two of the third electrode parts overlap with the florescent layer parts configured to emit a same color light and the at least two third electrode parts are electrically connected to one another.

11. The display apparatus of claim 10, wherein the light emitting units comprise:

a red light emitting unit to emit a first light having a red wavelength;

a green light emitting unit to emit a second light having a green wavelength; and a blue light emitting unit to emit a third light having a blue wavelength.

12. The display apparatus of claim 11, wherein the red, green, and blue light emitting units are arranged corresponding to the pixel, and the red, green, and blue light emitting units are successively operated within one frame of the display panel to sequentially provide the first to third lights to the pixel.

13. The display apparatus of claim 12, wherein a first data signal that controls the transmittance of the first light, a second data signal that controls the transmittance of the second light, and a third data signal that controls the transmittance of the third light are sequentially applied to the pixel during the one frame in correspondence with the red, green, and blue light emitting units.

14. The display apparatus of claim 11, wherein the base substrate is divided into a plurality of areas, a plurality of light generating blocks is arranged in the areas in one-to-one correspondence, and each of the light generating blocks includes the red, green, and blue light emitting units.

15. The display apparatus of claim 14, wherein the light generating blocks are successively operated to generate the first light during the first period, the second light during the second period, and the third light during the third period.

16. The display apparatus of claim 15, wherein the red light emitting unit is turned on and the green and blue light emitting units are turned off during the first period, the green light emitting unit is turned on and the blue and red light emitting units are turned off during the second period, and the blue light emitting unit is turned on and the red and green light emitting units are turned off during the third period.

17. The display apparatus of claim 15, wherein the display panel is divided into a plurality of display areas respectively corresponding to the areas, and one frame to display an image through the display panel includes the first to third periods.

18. The display apparatus of claim 14, wherein the light emitting units included in each of the light generating blocks are arranged in a matrix configuration, and the first electrodes of the light emitting units arranged in a row direction are electrically connected with each other to form a plurality of line electrodes.

19. A field emitting device comprising:

a base substrate;

a cathode electrode arranged on the base substrate;

first, second, and third field emitters arranged on the first electrode, the field emitters being distinct from on another;

first and second insulating sections arranged on the first electrode, the first insulating section located between the first and second field emitters and the second insulating section located between second and third field emitters;

first and second gate electrodes located on the first insulating section, the first and second gate electrodes spaced apart from one another at opposite edges of the first insulating section;

third and fourth gate electrodes located on the second insulating section, the third and fourth gate electrodes spaced apart from one another at opposite edges of the second insulating section;

an anode electrode facing the cathode electrode and spaced apart from the first electrode, wherein the anode electrode comprises first, second, and third anode electrodes;

a first fluorescent layer arranged on a surface of the anode electrode facing the cathode electrode to overlap the first field emitter and extend up to the right most edge of the first gate electrode;

a second fluorescent layer arranged on a surface of the anode electrode facing the cathode electrode to overlap the second field emitter and extend from the left most edge of the second gate electrode to the rightmost edge of the third gate electrode; and a third fluorescent layer arranged on a surface of the anode electrode facing the cathode electrode to overlap the third field emitter and extend to the left most edge of the fourth gate electrode, wherein each of the fluorescent layers are configured to output light of a different wavelength, wherein a first transmissive area is located between the first and second fluorescent layers and the first and second anode electrodes, wherein a second transmissive area is located between the second and third fluorescent layers and the second and third anode electrodes, wherein edges of the first and second anode electrodes contact the first transmissive area, and wherein edges of the second and third anode electrodes contact the second transmissive area.

20. The field emitting device of claim 19, wherein the first anode electrode, second anode electrode, and the third anode electrode are distinct from one another, the first anode electrode extending from a leftmost to a rightmost edge of the first fluorescent layer, the second anode electrode extending from a leftmost to a rightmost edge of the second fluorescent layer, and the third anode electrode extending from a leftmost to a rightmost edge of the third fluorescent layer.

* * * * *